US008635839B2

(12) United States Patent
Meinzinger

(10) Patent No.: US 8,635,839 B2
(45) Date of Patent: Jan. 28, 2014

(54) APPARATUS AND METHOD FOR PRODUCING PET BULK RECEPTACLES

(75) Inventor: Rupert Meinzinger, Kirchroth (DE)

(73) Assignee: Krones AG, Neutraubling (DE)

( * ) Notice: Subject to any disclaimer, the term of this patent is extended or adjusted under 35 U.S.C. 154(b) by 621 days.

(21) Appl. No.: 12/699,530

(22) Filed: Feb. 3, 2010

(65) Prior Publication Data

US 2010/0193073 A1 Aug. 5, 2010

(30) Foreign Application Priority Data

Feb. 3, 2009 (DE) ..... 10 2009 007 327

(51) Int. Cl.
*B65B 55/04* (2006.01)

(52) U.S. Cl.
USPC ..... 53/426; 53/467; 53/478; 53/111 R

(58) Field of Classification Search
USPC ..... 53/426, 432, 467, 478, 111 R
See application file for complete search history.

(56) References Cited

U.S. PATENT DOCUMENTS

| | | | | |
|---|---|---|---|---|
| 4,729,204 | A | 3/1988 | Weiss | |
| 5,090,440 | A * | 2/1992 | Ladouceur et al. | 137/209 |
| 5,649,575 | A | 7/1997 | Till | |
| 6,484,477 | B1 | 11/2002 | Bernhard | |
| 7,455,082 | B2 * | 11/2008 | Monzel | 141/18 |
| 7,877,967 | B2 * | 2/2011 | Monzel | 53/471 |
| 2007/0017574 | A1 * | 1/2007 | Till | 137/240 |
| 2009/0223175 | A1 | 9/2009 | Monzel | |
| 2010/0304944 | A1 | 12/2010 | Monzel | |

FOREIGN PATENT DOCUMENTS

| | | | | |
|---|---|---|---|---|
| DE | 35 15 334 | A1 | 10/1986 | |
| DE | 44 09 135 | C1 | 8/1995 | |
| DE | 100 01 200 | A1 | 7/2001 | |
| DE | 10 2006 026 279 | A1 | 12/2007 | |
| DE | 102007025286 | A1 * | 12/2008 | B67D 1/08 |
| EP | 0 692 426 | A1 | 1/1996 | |
| WO | 2008/145343 | A2 | 12/2008 | |

* cited by examiner

*Primary Examiner* — Hemant M Desai
(74) *Attorney, Agent, or Firm* — Novak Druce Connolly Bove + Quigg LLP

(57) ABSTRACT

A method for producing containers filled with liquids, wherein the containers are filled with the liquid and closed with a keg fitting, includes supplying the keg fitting to the container by means of a relative movement between the container and the keg fitting and connecting the keg fitting with the container. A cleaning treatment of the keg fitting is carrier out at least prior to or during the supply process or the connection process.

17 Claims, 2 Drawing Sheets

Fig. 1
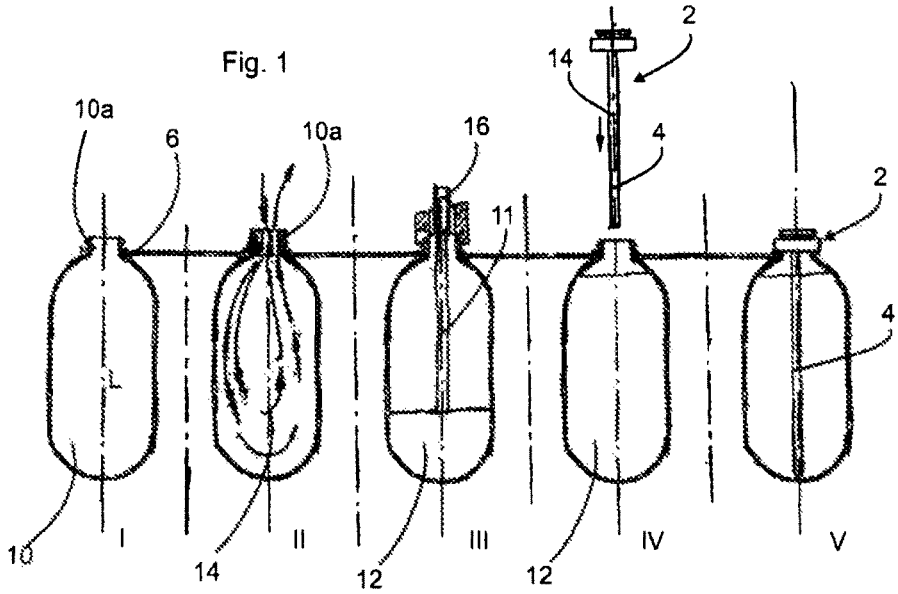
Fig. 2
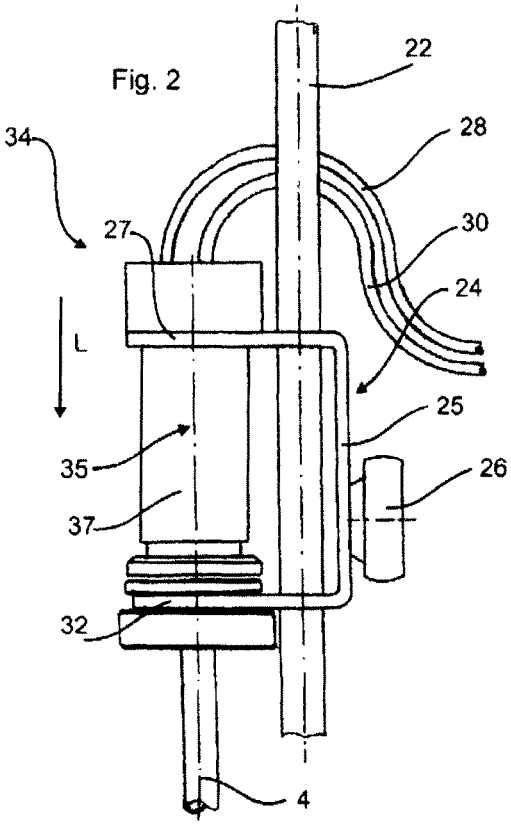
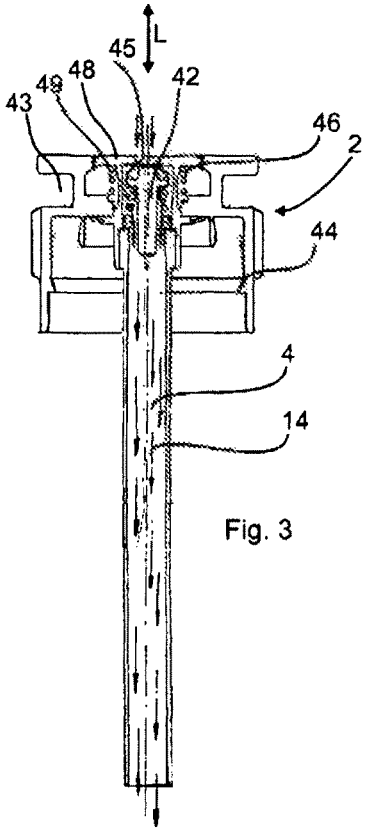
Fig. 3

Fig. 4
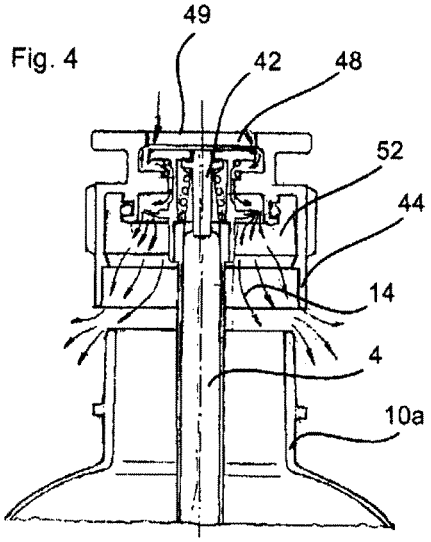
Fig. 5
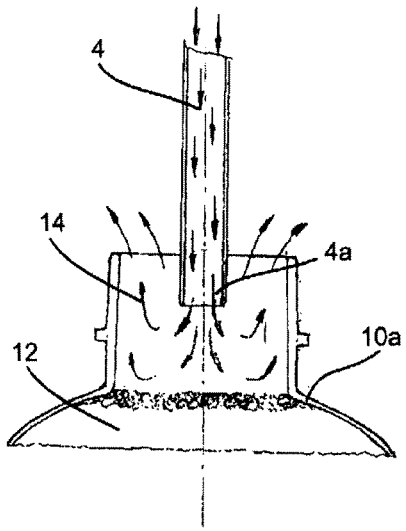
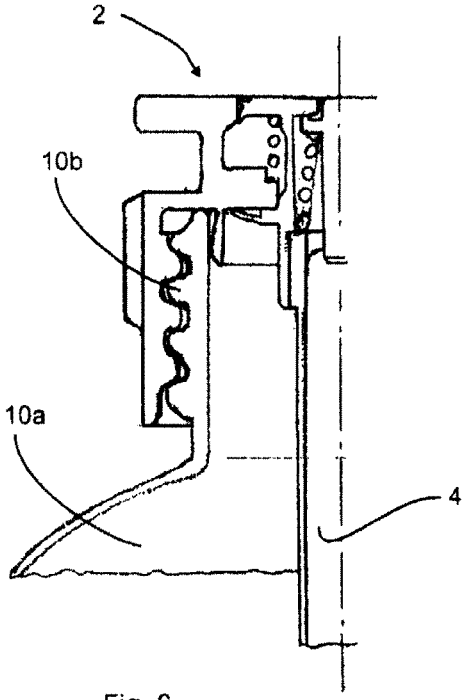
Fig. 6
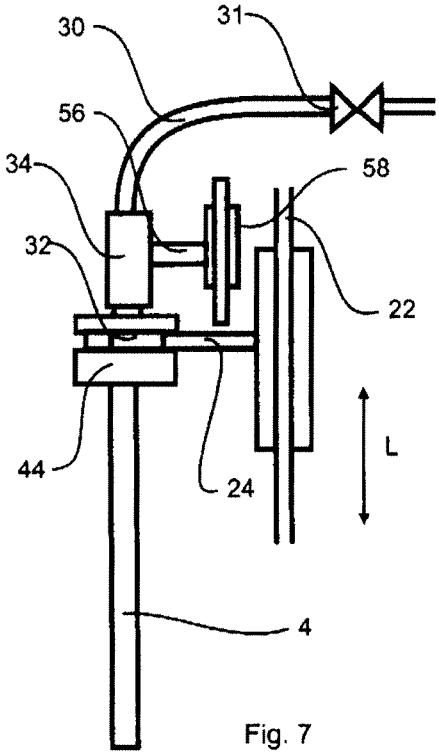
Fig. 7

APPARATUS AND METHOD FOR PRODUCING PET BULK RECEPTACLES

CROSS-REFERENCE TO RELATED APPLICATION

This application claims the benefit of priority of German Patent Application No. 10 2009 007 327.2, filed Feb. 3, 2009, pursuant to 35 U.S.C. 119(a)-(d), the disclosure of which is incorporated herein by reference in its entirety as if fully set forth herein.

TECHNICAL FIELD

The present disclosure relates to apparatuses and methods for producing containers filled with liquids and, in particular, for producing plastic bulk receptacles filled with liquids.

BACKGROUND

For a long time, barrels or so-called kegs have been known in the prior art, which are used for example as containers for beer or other liquids having a volume of more than 3 liters. Typical areas of use include public houses and restaurants. More recently, such kegs are however also used as party barrels or the like.

In recent times, there has been a tendency to use also plastic materials and in particular PET for such kegs.

DE 10 2006 026 279 A1 describes a method and an apparatus for producing packaging units or receptacles, wherein each receptacle is closed with a keg fitting and is filled with a liquid product. This filling of liquid product into the container is carried out with the container orientated in such a way that the fitting points upwards, however only after a tight connection between the container and said fitting has been made, i.e., after the container has been closed.

WO 2008/145343 describes a method and an apparatus for producing packaging units or receptacles. In this method, the container is initially filled and only then a tight connection between the container and the fitting or closure is established.

Such fittings or closures for the containers usually have a so-called fitting pipe, which in the mounted condition extends on the inside of the container. This fitting pipe is relatively sensitive, since it should, for example in the case of beer beverages, contain as little oxygen as possible. Also the fitting itself is relatively sensitive to handling, since in the case of a contamination of the fitting, any contaminants might also be introduced into the beverage.

It may therefore be desirable to provide methods and apparatuses for producing filled plastic bulk receptacles, which allows a higher degree of purity to be achieved compared to the prior art.

SUMMARY OF INVENTION

A method according to the disclosure for producing plastic containers filled with liquids, the containers are initially filled with the liquid and are subsequently closed with a keg fitting. According to the invention, the keg fitting is supplied by way of a relative movement between the container and the keg fitting, and the keg fitting is connected to the container, wherein at least prior to or during the supply process or the connection process (and in particular during the supply process), a cleaning treatment of the keg fitting is carried out.

A relative movement between the keg fitting and the container is understood to mean that either the keg fitting is actively moved or the container is moved or both the keg fitting and the container are moved towards each other. The connection process of the keg fitting with the container may thus comprise moving the keg fitting and the container up to one another on the one hand and then subsequently also connecting the keg fitting with the container on the other hand.

In the method according to the disclosure, the keg fitting may be moved up to an already filled container. According to the disclosure, it is therefore suggested that the keg fitting may be cleaned before it is supplied to the filled container, for example, during the actual supply process or the connection process. In some aspects, this cleaning of the keg fitting may be carried out during the supply process.

It is pointed out that instead of the term "plastic container," the term "container" will be sometimes interchangeably used below in order to simplify things.

A cleaning treatment of the keg fitting is here understood to mean any treatment which removes any substances from the keg fitting, which are detrimental to the container. Such detrimental substances may on the one hand be contaminants in a narrower sense, however, also any oxygen moieties which have an adverse effect on the shelf line of the beverage. Thus, also the removal of such oxygen moieties is understood as cleaning within the context of the present invention.

According to various aspects, an area of the keg fitting which is located within the produced container is cleaned. For example, a flushing of the above-mentioned fitting pipe may be carried out in order to ensure that no additional oxygen is introduced into the container to be closed.

In some aspects, the container may be initially filled with the liquid and only after that the container is closed with the keg fitting.

In the connection of the keg fitting with the container, for example, during the production process, the container is orientated in such a way that its mouth points upwards, i.e. the liquid is filled into the container from the top.

In accordance with various aspects, the pipe provided on the keg fitting may flushed with a gaseous medium, for example, carbon dioxide ($CO_2$). In this way for example, any oxygen moieties may be dispelled out of the pipe. Thus, no additional oxygen will be introduced into the container.

According to some aspects, liquid may be allowed to enter into the fitting pipe whilst the keg fitting is supplied up to the container. For example, it is possible that during the supply of the keg fitting to the container, a fitting closure on the inside (i.e. within the container) is opened, in order to enable the product to enter into the pipe while the pipe is submersed in the product, so that as little volume as possible is displaced.

In this way it is prevented that due to the rising filling level of a product, this product or even just product foam can get into the open via the mouth. This would on the one hand lead to a loss of product and on the other hand it could lead to product residues getting to areas outside of the container seal. This is a disadvantage since such product residues between the closure and the container could get mouldy, and humid containers can usually not be further processed to cartons, since they have been directly wetted with the product or with water. A wetting with water could occur whilst the product is being rinsed.

However, it would also be possible that the above-mentioned fitting closure is opened on the outside, i.e. outside of the container, in order to rinse the underside of the closure whilst the closure seal and the sealing surface are being brought together or immediately prior to that. It is possible to do this by means of a foaming up process in which the foam displaces the air in the closure. This procedure is used, for example, for containers which may be processed in a wet condition. It would be possible to apply these two procedures described either individually or also in combination.

In some aspects, the cleaning of the keg fitting system and in particular the flushing of the fitting pipe may be carried out during the relative movement between the keg fitting and the container. At this specific time of the flushing operation, time for the production process may be saved on the one hand. On the other hand, certain areas of the container may also be cleaned at the same time, as will be explained below.

In addition to or instead of the cleaning of the fitting, the keg fitting may also be rinsed or sprayed from the outside or submersed in a cleaning medium. In addition, sterilisation of the keg fitting or disinfection may be carried out, and here, for example, sterilisation by means of an ultraviolet (UV) lamp, and also spraying or rinsing or submersing with a liquid or cleaning with a gas is possible. Also sterilisation by means of an electron beam (E-Beam) may be carried out.

Thus it is suggested in general that during the bringing together of the filled container and of the closure or fitting, this closure is treated or actuated so that the quality of the packaging unit on the whole is improved.

In a further exemplary method, the fitting may be assembled or mounted either wholly or partially in a separate device, for example, prior to the actual process of bringing it together with the container.

In a further exemplary method, the keg fitting may be inspected, for example, during the connection process or the relative movement with the container. In this connection, also an inspection for tightness or for a suitable geometry may be carried out. Such inspection methods may for example involve an optical inspection by means of cameras for the presence of foam and the like.

Methods according to the disclosure may, for example, be carried out on a continuously operating circular machine which includes several treatment stations for containers which are arranged next to each other on a carousel.

The present disclosure is further directed to a process for producing containers filled with a liquid, and these containers are closed with a keg fitting and filled with a liquid, and a connection device is provided which connects the containers with the keg fitting, and this connection device moves the containers relative to the keg fitting, in particular in a longitudinal direction of the container.

According to the disclosure, the apparatus has at least one cleaning device which cleans at least one area of the keg fitting at least prior or during the relative movement of the keg fitting relative to the container or the connection process of the keg fitting with the container, and this cleaning device supplies the keg fitting towards a cleaning medium. This cleaning unit may, for example, be a unit which supplies a gaseous medium such as for example $CO_2$ to the keg fitting or a fitting pipe. In addition, however, also other cleaning units such as the above-mentioned UV or electron beam cleaning units would be conceivable.

According to various aspects, there is a preponderance of the connection unit of the keg fitting relative to the container in a longitudinal direction of the container. In some aspects, the keg fitting is supplied towards a mouth of the container, for example, from the top, so that it may be subsequently connected to the mouth of the container.

In a further exemplary method, the connection device has a gripping device for gripping the keg fitting. The gripping device may here be designed in such a way that the keg fitting is grasped in an area which is disposed above a mouth of the container even when the containers are in the assembled state.

The cleaning device may, for example, have a supply line which supplies a cleaning medium to the keg fitting. For example, this cleaning medium is supplied here to the above-mentioned pipe of the keg fitting.

In a further exemplary method, the cleaning device may be designed in such a way that the cleaning medium supplied to the keg fitting, and in particular to the above-mentioned pipe of the keg fitting, is supplied also to a head space of the container. In this way, the same medium that is used for flushing the line may also be used for flushing the above-mentioned head space, in particular, in the case of already filled containers.

Some further advantages and embodiments may become evident from the attached drawings.

BRIEF DESCRIPTION OF THE DRAWINGS

In the drawings:

FIG. 1 is a schematic view illustrating an exemplary procedure in accordance with various aspects of the disclosure;

FIG. 2 is a schematic view of an exemplary apparatus for attaching a keg fitting to a container in accordance with various aspects of the disclosure;

FIG. 3 is a schematic sectional view of an exemplary keg fitting in accordance with various aspects of the disclosure;

FIG. 4 is a schematic sectional view of the keg fitting of FIG. 3 immediately prior to the connection with a container;

FIG. 5 is a schematic view illustrating an exemplary head space flushing of a container;

FIG. 6 is a schematic sectional view of an exemplary keg fitting in accordance with various aspects of the disclosure; and FIG. 7 shows a further view of an exemplary filling apparatus in accordance with various aspects of the disclosure.

DETAILED DESCRIPTION

FIG. 1 is a schematic view illustrating an exemplary procedure for producing a filled container 10 such as, for example, a polyethylene terephthalate (PET) container or other types of containers. As shown in FIG. 1, the container 10 is held in each case by a gripping device 6 in the area of the mouth 10*a* (step I). In a process step 11, the container 10 is flushed on the inside, for example by means of a gaseous flushing medium 14. The flushing may also be carried out via the mouth 10*a* of the container 10.

In a third process step III, the container 10 is filled with a liquid 12, such as, for example, a beverage. To this end, a filling nozzle 16 is used which projects a minor distance into the mouth 10*a*, or is disposed slightly above the mouth 10*a*, and introduces a jet 11 of liquid into the container 10.

In a fourth process step IV, a keg fitting 2 is supplied to the container 10 which has already been filled with the liquid 12. During this process, the keg fitting is cleaned, as will be described in more detail below, and in this process, for example, a fitting pipe 4 of the keg fitting 2 is flushed with a particularly gaseous flushing medium. According to various aspects, the fitting pipe 4 may a rigid structure disposed on a base body 44 (FIG. 3) of the keg fitting 2. It should be understood that in some aspects, the fitting pipe 4 may be a more or less flexible hose. The flushing media 14 for flushing the container 10 and for flushing the fitting pipe 4 may be the same or different.

In a final process step V, the keg fitting 2 is connected with the container 10 and the fitting pipe 4 projects into the container 10.

In some conventional filling systems, it was possible to fill the plastic containers 10 exactly in the same way as conventional keg barrels made of metal, in particular in the same order. To this end, the keg fitting (the closure) 2 was until now attached to the container and then treated, flushed with $CO_2$, pre-stressed and filled with the product. The present disclosure, too, in principle allows this type of processing, so that existing machine concepts may be used.

FIG. 2 shows a lifting unit or connection device for a keg fitting 2, for example, a keg fitting 2 which is snapped onto a mouth 10*a* of the container 10. Alternatively, it would also be possible to provide a screw connection between the keg fitting 2 and the container 10.

The long lift needed to insert the keg fitting 2 into the container 10 or also for the further treatment and for pushing on and closing the container 10 is made possible here via a cam controlled roller 26 (the cam is not shown). However, it would also be possible to carry out this lift by pneumatic means or by means of a linear drive.

In the embodiment shown in FIG. 2, the keg fitting 2 is suspended in a metal sheet pocket 25 having here a semicircular recess, which is part of the connection device 24. However, it would also be possible to use a clamp system for supplying the keg fitting 2 to the container10, such as, for example, a gripping clamp which engages in a corresponding recess 43 (see FIG. 3) of the keg fitting 2.

In this way it is possible to move the keg fitting 2 without a punch 35 of the cleaning device 34 clamping the keg fitting 2. In this way it is also possible to clean and disinfect a surface of the keg fitting 2.

Reference numeral 32 relates to a corresponding gripping element or a closure carrier, by means of which the connection device 24 engages the keg fitting 2 via a recess 43 (see FIG. 3). Cleaning media such as, for example, a flushing medium for flushing the pipe 4 may be supplied via the punch 35 to the keg fitting 2. Here, the punch 35 is designed in such a way that it activates the keg fitting 2 in a desired manner, i.e. for example effects cleaning from the outside, from the inside or both. In this connection it is possible that this punch 35 is guided in its central portion 37 and is supplied in its upper portion pneumatically via two supply lines 28, 30 such as, for example, flexible hoses.

This corresponding pneumatic drive may also be supported or replaced by a mechanical drive. A guidance rod 22 may be provided for guiding the metal sheet pocket 24 in the longitudinal direction L of the container 10.

The corresponding media supply, which is needed here for treating the container and for supplying the system, is carried out in the embodiment shown in FIG. 2 by means of the flexible hoses 28, 30. It would, however, also be conceivable to use components which seal each other and which are disposed in a manner so that they are slidable relative to each other. The reference numeral 28 relates more specifically to a line for controlling a pneumatic cylinder, for example, for moving the unit. The punch 38 is used for connecting the keg fitting 2 and for sealing, that is, for supplying the flushing medium.

FIG. 3 shows a sectional view of an exemplary keg fitting 2. The keg fitting 2 includes a base body 44 which is secured to the container (not shown), and is, for example, pushed onto the mouth of the container. A first valve body 42 is slidable in a longitudinal direction L of the container in order to enable or block off any discharge out of the keg.

According to various aspects, by means of the first valve body 42, which is pre-stressed upwards by means of a spring 46 (and moveable in the direction L), any undesired flow of product through the fitting pipe 4 out of the container 10 may be prevented. To this end, the first valve body 42 may place itself on an opening 45. A second valve body 48, which in FIG. 3 is pre-stressed upwards by means of a spring 49, is moveable in the direction L. The second valve body 48 is used for closing a further opening 49 (see FIG. 4) of the keg fitting 2, in order to prevent any product form exiting the container 10 past the fitting pipe 4. In this second valve body 48, also the opening 45 closable by the first valve body 42 is disposed.

In the view shown in FIG. 3, the flushing medium 14 reaches the pipe 4 of the keg fitting 2 through the opening 45. The reference numeral 46 identifies, as mentioned above, a spring device which is used for closing and opening the inflow of the flushing medium 14 into the pipe 4 (more specifically, for pre-stressing the first valve body 42). By opening the valve or adjusting the valve body 42, flushing of the fitting pipe 4 may be effected.

FIG. 4 shows a view of an exemplary keg fitting which is about to be attached to the container 10 or the mouth 10*a*. In this condition it is possible that, by opening the second valve or displacing the second valve body 48, the flushing air 14 is directed through the keg fitting 2 in such a way that a flushing operation of the internal space 52 of the keg fitting 2 is carried out, and also the mouth area 10*a* of the container may be flushed. To this end, the flushing medium 14 also flows through the internal space 52 of the keg fitting. More specifically, the valve body 42 closes the opening 45, however the opening 49 which is otherwise closed by the second valve body 48 is exposed.

FIG. 5 shows a condition wherein the lower end 4*a* of the pipe 4 is located at the level of the container 10 already filled with the liquid 12, or put more accurately, at the level of the mouth 10*a*. In this situation, the flushing medium 14 will flow towards the outside via the pipe 4, so that also the head space 10*a* of the container 10 may be flushed.

FIG. 6 shows a corresponding embodiment of an exemplary keg fitting 2 for containers having screw caps, that is, for containers having an external thread 10*b*. The design of the keg fitting 2, in particular with regard to the pipe 4, may however also be as in the embodiment shown in FIG. 4.

FIG. 7, finally, shows a schematic view of an alternative bracket for the keg fitting 2. In this embodiment, too, a holding element 32 is provided which guides or holds the keg fitting 2, and this holding element 32 may be moved in the longitudinal direction L upwards or downwards via a moving unit. In addition, also the punch 35 or the application unit may be held here by its own holding device 56 and is moveable also in the longitudinal direction L by means of a moving unit 58.

The flushing medium may be supplied via a supply line 30, and a valve 31 may be configured to control the supply of the flushing medium to the pipe 4 and the container 10 via the supply line 30.

It will be apparent to those skilled in the art that various modifications and variations can be made to the apparatuses and methods for producing PET bulk receptacles of the present disclosure without departing from the scope of the invention. Other embodiments of the invention will be apparent to those skilled in the art from consideration of the specification and practice of the invention disclosed herein. It is intended that the specification and examples be considered as exemplary only.

What is claimed is:

1. A method for producing plastic containers filled with liquids, the plastic containers being filled with liquid and closed with a keg fitting, the method comprising:

supplying a filled plastic container with a keg fitting by means of a relative movement between the plastic container and the keg fitting;

connecting the keg fitting with the filled plastic container; and carrying out a cleaning treatment of the keg fitting during at least one of the supplying step and the connecting step.

2. The method as claimed in claim 1, wherein the step of connecting includes positioning the keg fitting within the produced container, the method further comprising cleaning an area of the keg fitting within the container.

3. The method as claimed in claim 1, further comprising filling the container with liquid and subsequently closing the container with the keg fitting.

4. The method as claimed in claim 1, further comprising orientating the plastic container with a mouth upwards during at least one of the supplying, connecting, and carrying out steps.

5. The method as claimed in claim 1, further comprising flushing a pipe disposed on the keg fitting with a gaseous medium.

6. The method as claimed in claim 5, further comprising allowing liquid to enter the pipe during the step of supplying of the keg fitting to the container.

7. The method as claimed in claim 5, wherein the step of carrying out a cleaning treatment of the keg fitting, including the flushing of the pipe, is carried out during said relative movement between the keg fitting and the container.

8. The method as claimed in claim 7, wherein the movement between the keg fitting and the container takes place in a longitudinal direction of the container.

9. The method as claimed in claim 5, wherein the gaseous medium is $CO_2$.

10. The method as claimed in claim 1, wherein the step of carrying out a cleaning treatment of the keg fitting is carried out during said relative movement between the keg fitting and the container.

11. The method as claimed in claim 1, wherein the step of carrying out a cleaning treatment of the keg fitting also effects a cleaning of a head space of the container.

12. The method as claimed in claim 1, further comprising inspecting the keg fitting.

13. The method as claimed in claim 12, wherein the inspecting step involves an optical inspection.

14. The method as claimed in claim 1, further comprising rinsing or spraying the keg fitting from the outside or submersing the keg fitting in a cleaning medium.

15. The method as claimed in claim 1, wherein the method is carried out on a continuously operated circular machine which includes several treatment stations for containers which are arranged next to each other on a carousel.

16. The method as claimed in claim 1, further comprising flushing the container on the inside.

17. A method for producing plastic containers, comprising:

filling a plastic container with liquid;

supplying the filled plastic container with a keg fitting by means of a relative movement between the plastic container and the keg fitting;

connecting the keg fitting with the filled plastic container to close the container; and carrying out a cleaning treatment of the keg fitting during at least one of the supplying step and the connecting step.

* * * * *